US009384865B2

(12) United States Patent
Kim et al.

(10) Patent No.: US 9,384,865 B2
(45) Date of Patent: Jul. 5, 2016

(54) TRANSPARENT CONDUCTOR, COMPOSITION FOR PREPARING THE SAME, AND OPTICAL DISPLAY APPARATUS INCLUDING THE SAME

(71) Applicants: Do Young Kim, Uiwang-si (KR); Young Kwon Koo, Uiwang-si (KR); Dong Myeong Shin, Uiwang-si (KR); Oh Hyeon Hwang, Uiwang-si (KR); Kyoung Ku Kang, Uiwang-si (KR)

(72) Inventors: Do Young Kim, Uiwang-si (KR); Young Kwon Koo, Uiwang-si (KR); Dong Myeong Shin, Uiwang-si (KR); Oh Hyeon Hwang, Uiwang-si (KR); Kyoung Ku Kang, Uiwang-si (KR)

(73) Assignee: CHEIL INDUSTRIES, INC., Gumi-si, Kyeongsangbuk-do (KR)

( * ) Notice: Subject to any disclaimer, the term of this patent is extended or adjusted under 35 U.S.C. 154(b) by 297 days.

(21) Appl. No.: 14/050,445

(22) Filed: Oct. 10, 2013

(65) Prior Publication Data

US 2014/0106154 A1 Apr. 17, 2014

(30) Foreign Application Priority Data

Oct. 11, 2012 (KR) ..... 10-2012-0113151

(51) Int. Cl.
*H01B 1/12* (2006.01)
*H01B 1/22* (2006.01)

(52) U.S. Cl.
CPC ..... *H01B 1/124* (2013.01); *H01B 1/22* (2013.01); *Y10T 428/31507* (2015.04)

(58) Field of Classification Search
None
See application file for complete search history.

(56) References Cited

U.S. PATENT DOCUMENTS

| | | | | |
|---|---|---|---|---|
| 8,018,568 | B2 * | 9/2011 | Allemand | B82Y 10/00 349/187 |
| 2007/0074316 | A1 * | 3/2007 | Alden | B82Y 30/00 257/784 |
| 2010/0197068 | A1 * | 8/2010 | Poon | H01L 31/022466 438/63 |
| 2010/0247870 | A1 * | 9/2010 | Suzuki | B22F 1/0059 428/172 |
| 2010/0255323 | A1 * | 10/2010 | Nakamura | H01B 1/22 428/457 |
| 2011/0018424 | A1 * | 1/2011 | Takada | H01L 31/022466 313/352 |
| 2011/0052926 | A1 * | 3/2011 | Nakamura | H01B 1/22 428/461 |
| 2011/0095275 | A1 * | 4/2011 | Li | H01L 51/442 257/40 |
| 2011/0291058 | A1 * | 12/2011 | Kunishi | G06F 3/044 252/514 |
| 2011/0297642 | A1 * | 12/2011 | Allemand | B82Y 10/00 216/13 |
| 2012/0098419 | A1 * | 4/2012 | Chiba | H01L 51/5206 428/292.1 |
| 2013/0258568 | A1 * | 10/2013 | Iwata | H01B 1/22 361/679.01 |

FOREIGN PATENT DOCUMENTS

| | | | | |
|---|---|---|---|---|
| CN | 101689568 | A | 3/2010 | |
| CN | 102481758 | A | 5/2012 | |
| CN | 102648542 | A | 8/2012 | |
| JP | 2010205532 | A * | 9/2010 | H01B 13/00 |

(Continued)

OTHER PUBLICATIONS

Office Action maield Nov. 5, 2014 in corresponding Korean Patent Application No. 10-2012-0113151.

(Continued)

*Primary Examiner* — David Sample
*Assistant Examiner* — Donald M Flores, Jr.
(74) *Attorney, Agent, or Firm* — Lee & Morse, P.C.

(57) ABSTRACT

A transparent conductor, a composition for the same, and an apparatus including the same, the transparent conductor including a transparent conductive film, the transparent conductive film including a metal nanowire and a conductive polymer, wherein the transparent conductor has a b* value of less than about 1.78 in color coordinates of CIE Lab at wavelengths of 400 nm to 700 nm.

19 Claims, 1 Drawing Sheet

(56) References Cited

FOREIGN PATENT DOCUMENTS

| | | | |
|---|---|---|---|
| KR | 2012-0003577 | A | 1/2012 |
| KR | 2012-0021451 | A | 3/2012 |
| KR | 10-2012-0038438 | A | 4/2012 |
| KR | 10-2012-0098140 | A | 9/2012 |
| KR | 10-2012-0099216 | A | 9/2012 |
| KR | 10-2012-0050431 | A | 12/2015 |
| WO | WO 2010082428 | A1 * | 7/2010 ..... H01L 51/442 |

OTHER PUBLICATIONS

Office Action dated Oct. 29, 2015 in corresponding Korean Patent Application No. 10-2012-0113151.

Office Action mailed Aug. 13, 2015 in corresponding Chinese Patent Application No. 201310473054.5.

* cited by examiner

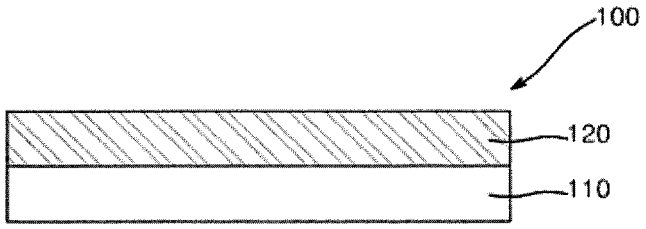
100
120
110

TRANSPARENT CONDUCTOR, COMPOSITION FOR PREPARING THE SAME, AND OPTICAL DISPLAY APPARATUS INCLUDING THE SAME

CROSS-REFERENCE TO RELATED APPLICATION

Korean Patent Application No. 10-2012-0113151 filed on Oct. 11, 2012, in the Korean Intellectual Property Office, and entitled: "TRANSPARENT CONDUCTOR, COMPOSITION FOR PREPARING THE SAME, AND OPTICAL DISPLAY APPARATUS COMPRISING THE SAME," is incorporated by reference herein in its entirety.

BACKGROUND

1. Field

Embodiments relate to a transparent conductor, a composition for preparing the same, and an optical display apparatus including the same.

2. Description of the Related Art

Conductive films, e.g., transparent conductive films, may be used in various applications, such as a touchscreen panel, flexible display, or the like, and may be included in a display apparatus. Thus, various studies have been actively made to develop transparent conductive films. The transparent conductive film should exhibit good properties, e.g., transparency, surface resistance, or the like.

Indium tin oxide (ITO) films have been used as transparent conductive films. An ITO film may be deposited on a base film by dry deposition to form a transparent conductor, and may have good economic feasibility and excellent transparency. ITO films may be deposited on a glass substrate. However, ITO films may increase resistance due to inherent characteristics thereof and may have low flexibility.

SUMMARY

Embodiments are directed to a transparent conductor, a composition for preparing the same, and an optical display apparatus including the same The embodiments may be realized by providing a transparent conductor including a transparent conductive film, the transparent conductive film including a metal nanowire and a conductive polymer, wherein the transparent conductor has a b* value of less than about 1.78 in color coordinates of CIE Lab at wavelengths of 400 nm to 700 nm.

The transparent conductor may have a haze value of about 1.0% to about 2.0% at wavelengths of 400 nm to 700 nm.

The transparent conductive film may have a deviation of surface resistance from about 5% to about 15%.

The transparent conductive film may be composed of a single layer.

The transparent conductive film may have a thickness of about 10 nm to about 300 nm.

The metal nanowire may be a silver nanowire, a copper nanowire, a gold nanowire, or a mixture thereof.

The metal nanowire may be present in an amount of about 85 wt % to about 99 wt % in the transparent conductive film.

An aspect ratio (L/d) of a length (L) of the metal nanowire to a cross-sectional diameter (d) of the metal nanowire may be about 10 to about 2,000.

The conductive polymer may include a water-based dopant.

The conductive polymer may include at least one of polystyrene sulfonate-doped polyethylene dioxythiophene or protein-doped polypyrrole.

The conductive polymer may be present in an amount of about 0.5 wt % to about 15 wt % in the transparent conductive film.

The transparent conductive film may be free from a compound including a urethane bond.

The transparent conductor may further include a base layer on the transparent conductive film, the base layer including at least one film selected from a polycarbonate film, a polyester film, a polyolefin film, a cyclic olefin polymer film, a polysulfone film, a polyimide film, a silicone film, a polystyrene film, a polyacryl film, or a polyvinyl chloride film.

The transparent conductive film may be formed of a composition including the metal nanowire, the conductive polymer, and a heat curing agent.

The composition may further include a UV curable unsaturated compound and a photopolymerization initiator.

The embodiments may also be realized by providing a composition for a transparent conductive film, the composition including a metal nanowire, a conductive polymer, and a heat curing agent.

The composition may include about 90 wt % to about 95 wt % of the metal nanowire, about 5 wt % to about 10 wt % of the conductive polymer, and about 0.01 parts by weight to about 1 part by weight of the heat curing agent, based on 100 total parts by weight of the metal nanowire and the conductive polymer.

The composition may further include a UV curable unsaturated compound and a photopolymerization initiator.

The composition may include about 95 wt % to about 97 wt % of the metal nanowire, about 1 wt % to about 3 wt % of the conductive polymer, about 2 wt % to about 4 wt % of the UV curable unsaturated compound, and about 0.01 parts by weight to about 1 part by weight of the heat curing agent and about 0.01 parts by weight to about 1 part by weight of the photopolymerization initiator, based on 100 total parts by weight of the metal nanowire, the conductive polymer, and the UV curable unsaturated compound.

The embodiments may also be realized by providing an optical display apparatus including the transparent conductor according to an embodiment.

BRIEF DESCRIPTION OF THE DRAWING

Features will be apparent to those of skill in the art by describing in detail exemplary embodiments with reference to the attached drawing in which:

FIG. 1 illustrates a sectional view of a transparent conductor in accordance with one embodiment.

DETAILED DESCRIPTION

Example embodiments will now be described more fully hereinafter with reference to the accompanying drawing; however, they may be embodied in different forms and should not be construed as limited to the embodiments set forth herein. Rather, these embodiments are provided so that this disclosure will be thorough and complete, and will fully convey exemplary implementations to those skilled in the art.

In the drawing FIGURE, the dimensions of layers and regions may be exaggerated for clarity of illustration. Like reference numerals refer to like elements throughout.

FIG. 1 illustrates a sectional view of a transparent conductor in accordance with one embodiment. Referring to FIG. 1, a transparent conductor 100 may include a base layer 110 and a transparent conductive film 120 on an upper surface of the base layer 110.

The transparent conductor of the transparent conductive film may have a b* value of less than about 1.78, e.g., less than 1.78, about 1.77 or less, or from about 0.5 to about 1.6, in color coordinates of CIE Lab or lab color space at wavelengths of 300 nm to 1,000 nm, e.g., at wavelengths from 400 nm to 700 nm. The transparent conductive film may be peeled off the base layer of the transparent conductor to be attached to, e.g., a touchscreen panel, a flexible display, E-paper, or a photovoltaic cell. Maintaining the b* value of the transparent conductor or the transparent conductive film at less than about 1.78 may help reduce and/or prevent undesirable yellowish showing when the transparent conductive film is stacked on the panel or the like.

The b* value may be measured on or with respect to the transparent conductive film or the transparent conductor (which may be prepared by forming the transparent conductive film (thickness: 100 nm to 200 nm) on the base layer, e.g., a polycarbonate film, (thickness: about 50 μm)) using a Konica Minolta CIE spectrometer at wavelengths from 300 nm to 1,000 nm, e.g., at wavelengths from 400 nm to 700 nm. The b* value may be a transparent b* value and/or a positive b* value.

In an implementation, the transparent conductive film may include a cured product of a composition. The composition may include, e.g., metal nanowires, a conductive polymer, and a heat curing agent. In an implementation, the composition may further include, e.g., a UV curable unsaturated compound and/or a photopolymerization initiator. Curing may be carried out by, e.g., heat-curing, photocuring, or a combination thereof.

The metal nanowires may form an electrically conductive network, thereby providing good conductivity, flexibility, and bending properties to the transparent conductive film. In addition, the metal nanowires may provide better dispersibility than metal nanoparticles, and may significantly reduce surface resistance of the transparent conductive film.

The metal nanowires may be ultrafine wires having a specific cross-section. For example, an aspect ratio (L/d) of a metal nanowire length (L) to a metal nanowire diameter (d) may be about 10 to about 2,000. Within this aspect ratio range, the nanowires may realize high conductivity in a low density, and may further reduce surface resistance. In an implementation, the aspect ratio may be, e.g., greater than about 500 and up to 1,000, or 501 to 700.

The metal nanowires may have a diameter (d) of greater than 0 and 100 nm or less. Within this diameter range, the metal nanowires may help secure a high aspect ratio (L/d), and the transparent conductive film containing the metal nanowire may have high conductivity and low surface resistance. In an implementation, the metal nanowires may have a diameter of about 30 nm to about 100 nm, e.g., about 20 nm to about 40 nm. The metal nanowires may have a length (L) of, e.g., about 20 μm or more. Within this length range, the metal nanowires may secure a high aspect ratio (L/d), so that the transparent conductive film containing the metal nanowire may have high conductivity and low surface resistance. In an implementation, the metal nanowires may have a length of, e.g., about 20 μm to about 50 μm.

The metal nanowires may include nanowires prepared from a certain metal, which may be selected from among, e.g., silver, copper, gold, or mixtures or combinations thereof. In an implementation, the metal nanowire may be silver nanowires or may be formed of a mixture including the silver nanowires.

The metal nanowires may be prepared by a suitable method or may be commercially available. For example, the metal nanowires may be prepared by reduction of a metal salt (such as silver nitrate $AgNO_3$) in the presence of polyol and polyvinyl pyrrolidone. Alternatively, the metal nanowires may be products manufactured by Clearohm Inc.

In an implementation, the metal nanowires may be present in an amount of about 50 wt % to about 99 wt %, e.g., about 85 wt % to about 95 wt % or about 90 wt % to about 95 wt %, relative to a total weight of the metal nanowires and the conductive polymer. Within this content range, the metal nanowires may form a conductive network and help secure sufficient conductivity.

In an implementation, the metal nanowire may be present in the transparent conductive film or the composition in an amount of about 85 wt % to about 99 wt %, e.g., from about 88 wt % to about 96 wt %. Within this range, the metal nanowires may help secure sufficient conductivity, may help reduce deviation in surface resistance, and may help suppresses a yellowish showing.

The conductive polymer may help compensate for deviation of non-uniform surface resistance of the metal nanowires used alone in a conductive film, and may help provide the color coordinate b* value of less than about 1.78, and reduce milkiness.

The conductive polymer may form a matrix in which a conductive network of the metal nanowire is impregnated. The matrix may maintain a shape of the electrically conductive network to secure conductivity, and may help reduce and/or prevent corrosion of the electrically conductive network due to moisture, or may help reduce and/or prevent damage due to external impact when the electrically conductive network is provided to the apparatus. The matrix may have a physically strong structure to help maintain the electrically conductive network of the metal nanowires. In addition, the matrix may exhibit optical transparency, in consideration of use of the conductors. For example, the matrix may have transparency in the visible light range, such as at wavelengths of 400 nm to 700 nm. When measured using a haze meter, the matrix may have a haze value of about 3% or less, and transparency corresponding to a total luminous transmittance of 90% or more. In an implementation, the matrix may have a haze value of about 1% to about 2.6%, and a total luminous transmittance of about 90 to about 95%.

The conductive polymer may be free of a urethane group, e.g., may be a urethane group-free polymer or a polymer that does not include a urethane bond. The conductive polymer may include, e.g., at least one selected from polythiophene, polypyrrole, poly(alkylthiophene) including poly(3-alkylthiophene) or the like, polyethylene dioxythiophene, poly(dialkoxyphenylenevinylene) including poly(2,5-dialkoxy-p-phenylenevinylene) or the like, poly(phenylenevinylene) including poly(p-phenylenevinylene) or the like, or poly(phenylene) including poly(p-phenylene) or the like. For example, when preparing the conductive film, the conductive polymer may be mixed with a metal nanowire-containing solution prepared using a water-based solvent (such as water, alcohol, or the like). Thus, the conductive polymer may include a water-based conductive polymer. For example, the conductive polymer may employ a polymer including water-based molecules as dopants for mixing with the metal nanowires. In an implementation, the conductive polymer may include at least one of polystyrene sulfonate-doped polyethylene dioxythiophene (PEDOT-PSS) or protein-doped polypyrrole.

The conductive polymer may have a weight average molecular weight of about 150,000 g/mol to 200,000 g/mol.

Within this range of the weight average molecular weight, the conductive polymer may form a sufficient conductive network.

In an implementation, the conductive polymer may be present in an amount of about 1 wt % to about 50 wt %, e.g., about 5 wt % to about 15 wt % or about 5 wt % to about 10 wt %, relative to the total weight of the metal nanowire and the conductive polymer. Within this range, the conductive polymer may help secure sufficient conductivity after curing and may form a conductive network.

In an implementation, the conductive polymer may be present in the transparent conductive film or composition in an amount of about 0.5 wt % to about 15 wt %, e.g., from about 0.5 wt % to about 10 wt %. Within this range, the conductive polymer may help reduce deviation of the surface resistance while suppressing a yellowish showing.

The heat curing agent may include, e.g., cellulose acetate butyrate (CAB) or the like.

The heat curing agent may be present in the composition an amount of about 0.01 parts by weight to about 2 parts by weight, e.g., about 0.01 parts by weight to 1 part by weight, relative to 100 total parts by weight of the metal nanowires and the conductive polymer. Within this range, the heat curing agent may sufficiently cure the metal nanowires and the conductive polymer without an initiator such that the metal nanowires may be sufficiently impregnated in the conductive polymer.

In an implementation, the composition for the transparent conductive film may include about 50 wt % to about 99 wt % of the metal nanowires, about 1 wt % to about 50 wt % of the conductive polymer, and about 0.01 parts by weight to 2 parts by weight of the heat curing agent, relative to 100 total parts by weight of the metal nanowires and the conductive polymer. In an implementation, the composition for the transparent conductive film may include about 90 wt % to about 95 wt % of the metal nanowires, about 5 wt % to about 10 wt % of the conductive polymer, and about 0.01 parts by weight to 1 part by weight of the heat curing agent, relative to 100 total parts by weight of the metal nanowires and the conductive polymer.

In an implementation, the composition may further include a UV curable unsaturated compound and/or a photopolymerization initiator, in addition to the metal nanowires, the conductive polymer, and the heat curing agent.

The UV curable unsaturated compound may form the matrix in which the electrically conductive network of the metal nanowires is impregnated after curing. The UV curable unsaturated compound may help provide chemical resistance and/or weather resistance to the transparent conductive film.

The UV curable unsaturated compound may be free from a urethane bond or urethane group, and may include at least one of a monofunctional monomer or a polyfunctional monomer. The mono-functional monomer and the polyfunctional monomer may help improve transparency of the matrix and may help reduce surface resistance when the monomers are mixed with the metal nanowires and then cured. Other types of transparent conductive films, e.g., films prepared from a polymer or oligomer containing urethane acrylate, may exhibit an undesirable degree of transparency and may have relatively high surface resistance.

The monofunctional monomer may be a monomer containing one (meth)acrylate group, and may be selected from among a (meth)acrylic ester containing a $C_1$ to $C_5$ alkyl group, (meth)acrylic ester containing a $C_1$ to $C_5$ alkyl group and hydroxyl group, a (meth)acrylic ester containing a $C_4$ to $C_{10}$ hetero-alicyclic group, a (meth)acrylic ester containing a $C_6$ to $C_{10}$ aryl group, a (meth)acrylic ester containing a $C_5$ to $C_{10}$ alicyclic group, a (meth)acrylic ester containing a $C_7$ to $C_{11}$ arylalkyl group, or mixtures thereof. In an implementation, the monofunctional monomer may include, e.g., methyl (meth)acrylate, ethyl (meth)acrylate, propyl (meth)acrylate, cyclohexyl (meth)acrylate, isobornyl (meth)acrylate, 2-hydroxyethyl (meth)acrylate, phenyl (meth)acrylate, benzyl (meth)acrylate, or mixtures thereof.

The monofunctional monomer may be present in the composition in an amount of about 1 wt % to 15 wt %, relative to a total weight of the metal nanowires, the conductive polymer, and the UV curable unsaturated compound. Within this range, the monofunctional monomer may help secure sufficient conductivity after curing and may form the electrically conductive network. In an implementation, the monofunctional monomer may be present in an amount of about 1 wt % to about 10 wt %, e.g., about 1 wt % to about 5 wt %.

The polyfunctional monomer may be a monomer having two or more (meth)acrylate groups, e.g., about two to six (meth)acrylate groups. The polyfunctional monomer may include, e.g., a polyfunctional (meth)acrylate of a polyhydric alcohol containing at least two hydroxyl groups, e.g., about two to six hydroxyl groups, a fluorine-modified polyfunctional (meth)acrylate, or mixtures thereof.

The polyfunctional (meth)acrylate of the polyhydric alcohol may include, e.g., dipentaerythritol hexa(meth)acrylate, trimethylolpropane tri(meth)acrylate, pentaerythritol tetra (meth)acrylate, ditrimethylolpropane tetra(meth)acrylate, pentaerythritol tri(meth)acrylate, tris(2-hydroxyethyl) isocyanurate tri(meth)acrylate, glycerol tri(meth)acrylate, ethylene glycol di(meth)acrylate, neopentyl glycol di(meth) acrylate, hexanediol di(meth)acrylate, trimethylolpropane di(meth)acrylate, dipentaerythritol penta(meth)acrylate, pentaerythritol tetra(meth)acrylate, or cyclodecane dimethanol di(meth)acrylate.

The fluorine-modified polyfunctional (meth)acrylate compound may be formed by reaction between a perfluoro polyether compound and a polyfunctional (meth)acrylate. For example, the perfluoro polyether compound may include a hydroxyl group-containing perfluoro polyether polyol, a carboxylic acid group-containing perfluoro polyether dibasic acid, an epoxy group-containing perfluoro polyether epoxy compound, or the like. The polyfunctional (meth)acrylate may include at least one selected from among a carboxylic acid group-containing modified (meth)acrylate, an epoxy group-containing (meth)acrylate, an isocyanate group-containing (meth)acrylate, or the like.

The polyfunctional monomer may have a weight average molecular weight of about 200 g/mol to about 600 g/mol. Within this range, the polyfunctional monomer may help realize a matrix exhibiting good transparency and flexural characteristics, and may help provide coatability and wettability with respect to a base film. In an implementation, the polyfunctional monomer may have a weight average molecular weight of about 296 g/mol to about 579 g/mol.

As for the polyfunctional monomer, polyfunctional monomers having a same number of (meth)acrylate groups or a mixture of polyfunctional monomers having different numbers of (meth)acrylate groups may be used.

The polyfunctional monomer may be present in the composition in an amount of about 1 wt % to 15 wt %, relative to the total weight of the metal nanowires, the conductive polymer, and the UV curable unsaturated compound. Within this content range of the polyfunctional monomer, the composition may exhibit sufficient conductivity after curing, and may form an electrically conductive network. The polyfunctional monomer may be present in an amount of about 1 wt % to about 10 wt %, e.g., about 1 wt % to about 5 wt %.

The UV-curable unsaturated compound may be present in the composition in an amount of about 0.1 wt % to about 10 wt %, e.g., about 2 wt % to about 4 wt %, relative to the total weight of the metal nanowires, the conductive polymer, and the UV curable unsaturated compound. Within this range, the composition may provide a transparent conductive film exhibiting good chemical resistance and weather resistance.

The photopolymerization initiator may include, e.g., a phosphine oxide-based compound, α-hydroxy ketone compound, or the like. In an implementation, the photopolymerization initiator may be selected from among bis-acyl-phosphine oxide (BAPO), 2,4,6-trimethylbenzoylphosphine oxide (TPO), 1-hydroxycyclohexylphenylketone, or mixtures thereof.

The photopolymerization initiator may be present in the composition in an amount of about 0.1 parts by weight to about 5 parts by weight, e.g., about 0.1 parts by weight to about 1 part by weight, relative to 100 total parts by weight of the metal nanowires, the conductive polymer, and the UV curable unsaturated compound. Within this range, the initiator may achieve sufficient curing of the composition for the transparent conductive film without remaining in the composition.

The composition for the transparent conductive film may include about 50 wt % to about 99 wt % of the metal nanowires, about 0.1 wt % to about 40 wt % of the conductive polymer, about 0.1 wt % to about 10 wt % of the UV curable unsaturated compound, and about 0.01 parts by weight to about 2 parts by weight of the heat curing agent and 0.1 parts by weight to about 1 part by weight of the photopolymerization initiator, relative to 100 total parts by weight of the metal nanowires, the conductive polymer, and the UV curable unsaturated compound. In an implementation, the composition for the transparent conductive film may include about 95 wt % to about 97 wt % of the metal nanowire, about 1 wt % to about 3 wt % of the conductive polymer, about 2 to about 4 wt % of the UV curable unsaturated compound, and about 0.01 parts by weight to about 1 part by weight of the heat curing agent and 0.1 parts by weight to about 1 part by weight of the photopolymerization initiator, relative to 100 total parts by weight of the metal nanowires, the conductive polymer and the UV curable unsaturated compound.

The transparent conductive film may have a surface resistance of about 300Ω/□ or less, e.g., about 50Ω/□ to about 250Ω/□, as measured using a 4-probe tester. Within this range, the transparent conductive film may be used as a film for touch panels and may have improved sensing performance due to low surface resistance.

The transparent conductive film may have a deviation of surface resistance of about 5% to about 15%, as measured using a 4-probe tester. Other types of transparent conductive films including metal nanowires alone may have non-uniform surface resistance due to the metal nanowires, and thus may have high deviation of the surface resistance on the same surface. The transparent conductive film according to an embodiment may include the conductive polymer together with the metal nanowires, which may help reduce and/or prevent deviation of the surface resistance on the same surface.

The transparent conductive film may have a monolayer structure. In an implementation, the transparent conductive film may have a monolayer structure in which the metal nanowires are dispersed in the matrix composed of the conductive polymer or in the matrix composed of the conductive polymer and the cured UV curable unsaturated compound, and may be free from an overcoat layer, e.g., a urethane group-containing coating layer.

The transparent conductive film may be free from a urethane bond, e.g., may not include a compound having a urethane bond therein. Other types of transparent conductive films including metal nanowires may include a urethane (meth)acrylate binder to provide adhesion to a base film and chemical resistance. However, the transparent conductive film according to an embodiment may include the conductive polymer, or both the conductive polymer and the UV curable unsaturated compound, without containing a urethane (meth) acrylate binder.

The transparent conductive film may have a thickness from about 10 nm to about 1 μm, e.g., from about 10 nm to about 300 nm. Within this thickness range, the transparent conductive film may exhibit low haze value and high transmittance.

The composition for transparent conductive films may further include a solvent to facilitate film formation while improving coatability with respect to the base layer. In an implementation, the solvent may include a main solvent and a co-solvent due to different properties between the metal nanowires and the polyfunctional monomer. Examples of the main solvent may include water, alcohol, ketone-based solvents, or the like, and examples of the co-solvent may include alcohols such as methanol to facilitate mixing of water with other solvents.

The base layer may support the transparent conductive film. A suitable film or substrate capable of imparting flexibility to the transparent conductive film and exhibiting transparency may be used as the base layer. For example, the base layer may be selected from polycarbonate, polyesters (including polyethylene terephthalate (PET), polyethylene naphthalate, or the like), polyolefin, cyclic olefin polymer, polysulfone, polyimide, silicone, polystyrene, polyacryl, or polyvinyl chloride films.

The base layer may have a thickness of about 10 μm to about 250 μm, e.g., about 10 μm to about 100 μm. Within this range, the base layer may sufficiently support the transparent conductive film and may help impart flexibility to the film.

The transparent conductor may be prepared by a suitable method using the base layer and the composition for transparent conductive films. For example, the composition for transparent conductive films may be coated on at least one side of the base film, followed by drying and baking. Drying and baking may be performed at about 80° C. to about 140° C. for about 1 to 3 minutes. In addition, the film may be subjected to UV curing after drying. UV curing may be performed at about 500 mJ/cm$^2$ or more, e.g., at about 500 mJ/cm$^2$ to about 1,000 mJ/cm$^2$.

The transparent conductor may further include functional films on one or both sides of the base layer. The functional films may include, e.g., a hard coating layer, an anti-corrosion layer, or the like.

The transparent conductor may have a haze value of about 1.0% to about 2.0% at wavelengths of 400 nm to 700 nm. Within this range, the transparent conductor may help improve (e.g., reduce) visibility of a pattern when used for a touch panel.

The transparent conductor may have a thickness of about 10.01 μm to about 251 μm, e.g., about 50 μm to about 51 μm. Within this thickness range of the transparent conductor, a transparent conductive film having low haze and transmittance may be provided.

Another embodiment provides an optical display apparatus including the transparent conductor or the transparent conductive film. Examples of the optical display apparatus may include touchscreen panels, flexible displays, E-paper, solar cells, or the like.

The following Examples and Comparative Examples are provided in order to highlight characteristics of one or more embodiments, but it will be understood that the Examples and Comparative Examples are not to be construed as limiting the scope of the embodiments, nor are the Comparative Examples to be construed as being outside the scope of the embodiments. Further, it will be understood that the embodiments are not limited to the particular details described in the Examples and Comparative Examples.

Details of components used in the Examples and Comparative Examples were as follows:

(A) Metal nanowire: silver nanowires (ClearOhm ink, Cambrios)

(B) Conductive polymer: PEDOT-PSS (Baytron)

(C) Heat curing agent: CAB (Cellulose acetate butyrate)

(D) UV-curable unsaturated compound: (D1) Isobornyl acrylate (SR506A, Satomer), (D2) Trimethylolpropane triacrylate (TMPTA, SK Cytec)

(E) Photopolymerization initiator: IRG-184 (CIBA)

EXAMPLE 1

A conductive film composition was prepared using components as listed in Table 1, below (unit: parts by weight). Metal nanowires were stirred in 33 parts by weight of ultrapure distilled water to prepare solution A. A conductive polymer and a heat curing agent were dissolved in 9 parts by weight of methanol to prepare solution B. The prepared solutions A and B and 9 parts by weight of methanol were mixed to prepare a conductive film composition. Then, the prepared conductive film composition was coated onto a base layer (polycarbonate film, thickness: 50 μm) using a Meyer Bar #18 coating method.

The resultant was dried in an oven at 80° C. for 120 seconds, followed by baking at 140° C. for 120 seconds, thereby preparing a transparent conductor that included a single-layered transparent conductive film having a thickness of 100 nm to 200 nm on the base layer.

EXAMPLE 2

A transparent conductor was prepared in the same manner as in Example 1, except for the amounts of the metal nanowires, the conductive polymers, and the heat curing agent, which were as listed in Table 1.

EXAMPLE 3

A conductive film composition was prepared using components as listed in Table 1 (unit: parts by weight). Metal nanowires were stirred in 33 parts by weight of ultrapure distilled water to prepare solution A. The conductive polymer, (D1) SR506A, (D2) TMPTA, a heat curing agent, and a photopolymerization initiator were dissolved in 5 parts by weight of acetone to prepare solution B. The prepared solutions A and B and 9 parts by weight of methanol were mixed to prepare a conductive film composition.

Then, the prepared conductive film composition was coated onto a base layer (polycarbonate film, thickness: 50 μm) using a Meyer Bar #18 coating method. The resultant was dried in an oven at 80° C. for 120 seconds, followed by baking at 140° C. for 120 seconds. Then, the baked resultant was subjected to UV curing under a metal halide lamp at 500 mJ/cm$^2$ in a nitrogen atmosphere, thereby preparing a transparent conductor including a single-layered transparent conductive film having a thickness of 100 nm to 200 nm on the base layer.

EXAMPLE 4

A transparent conductor was prepared in the same manner as in Example 3, except for the amounts of the metal nanowires, the conductive polymer, the UV-curable unsaturated compound, the heat curing agent, and the photopolymerization initiator, which were as listed in Table 1.

COMPARATIVE EXAMPLE 1

100 parts by weight of metal nanowires was stirred in 33 parts by weight of ultrapure distilled water to prepare a conductive film composition. Then, the prepared conductive film composition was coated onto a base layer (polycarbonate film, thickness: 50 μm) using a Meyer Bar #18 coating method. The resultant was dried in an oven at 80° C. for 120 seconds, followed by baking at 140° C. for 120 seconds, thereby providing a transparent conductor including a single-layered conductive film having a thickness of 100 nm to 200 nm on the base layer.

TABLE 1

| | | Example 1 | Example 2 | Example 3 | Example 4 | Comparative Example 1 |
|---|---|---|---|---|---|---|
| (A) | | 90 | 95 | 95 | 95 | 100 |
| (B) | | 10 | 5 | 3 | 1 | — |
| (C) | | 1 | 0.5 | 0.03 | 0.01 | — |
| (D) | (D1) | — | — | 1 | 2 | — |
| | (D2) | — | — | 1 | 2 | — |
| (E) | | — | — | 0.02 | 0.04 | — |

The prepared transparent conductors were evaluated as to the following properties.

(1) Surface resistance and deviation of surface resistance: Surface resistance of the conductive film was measured using a surface resistance tester MCP-T610 (Mitsubishi Chemical Analytech Co., Ltd.) after 10 seconds from a time point of bringing four probes of the surface resistance tester into contact with a surface of the conductive film. Deviation of surface resistance was calculated using a difference between a maximum value and a minimum value from an average value of surface resistance.

(2) Haze and total luminous transmittance: With a surface of the conductive film disposed to face a light source, the haze and the total luminous transmittance of the conductive film were measured using a haze meter (NDH-9000) at a wavelength of 400 nm~700 nm.

(3) b*: The color coordinate b* value of the transparent conductor was measured using a Konica Minolta CIE Lab spectrometer (CM6000D) at a wavelength of 300 nm to 1,000 nm (optimal wavelength: 400-700 nm).

(4) IPA rubbing: With a sufficient amount of isopropyl alcohol (IPA) applied to one surface of the conductive film, rubbing was performed 10 times using a semiconductor wiper to evaluate removal of the conductive film. When the conductive film was not removed by rubbing 9 times, the result was evaluated as high. When the conductive film was removed by rubbing 6 times to 8 times, the result was evaluated as medium, and when the conductive film was removed by rubbing 5 times or less, the result was evaluated as low.

TABLE 2

| | Surface resistance (Ω/□) | Deviation of surface resistance (%) | Haze (%) | Total luminous transmittance (%) | b* | IPA rubbing |
|---|---|---|---|---|---|---|
| Example 1 | 100~120 | <10 | 1.29 | 89.02 | 1.37 | Low |
| Example 2 | 50~60 | <10 | 1.38 | 90.02 | 1.51 | Low |
| Example 3 | 150~170 | <15 | 1.54 | 88.42 | 0.85 | Medium |
| Example 4 | 200~250 | <15 | 1.40 | 88.07 | 0.94 | High |
| Comparative Example 1 | 50~60 | <15 | 1.31 | 89.19 | 1.78 | Low |

In Table 2, above, it may be seen that the conductive films according to the Examples had low b* values, and thus did not exhibit a yellowish showing of the transparent conductive film. The conductive films according to the Examples allowed efficient curing (based on the results of IPA rubbing), and had good weather resistance and reliability and low deviation of surface resistance. The transparent conductive film prepared using the metal nanowires alone in Comparative Example 1 had a higher b* value than the Examples and exhibited poor weather resistance and reliability according to the results of IPA rubbing.

By way of summation and review, a transparent conductor may be prepared using a transparent conductive film including metal nanowires (such as silver nanowires or the like). A transparent conductive film including the metal nanowires alone may exhibit low solvent resistance and low adhesion to a substrate such as a base layer. Thus, the transparent conductor may be prepared with multi-layer structure by coating an overcoat layer on the metal nanowires.

Patterns may be visible through a conductive film that includes metal nanowires when stacked on a touchscreen or the like. A conductive film that includes metal nanowires may also exhibit yellowish showing (e.g., milkiness) by which the film surface exhibits or appears yellow due to an inherent color of the metal nanowires. Thus, the conductive film may further include a blue pigment for color correction. However, non-conductivity of the pigment may cause an increase in surface resistance of the conductive film. In addition, the conductive film including the metal nanowires may exhibit uneven surface resistance, thereby causing a high deviation of surface resistance.

The embodiments may provide a transparent conductor, which includes a transparent conductive film, and may be capable of reducing and/or preventing uneven surface resistance caused by metal nanowires, preventing pattern visibility, and preventing yellowish showing of the conductive film due to an inherent color of the metal nanowires, and may exhibit low surface resistance and high transmittance.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. A transparent conductor, comprising:

a transparent conductive film, the transparent conductive film including a metal nanowire and a conductive polymer, wherein the transparent conductor has a b* value of less than about 1.78 in color coordinates of CIE Lab at wavelengths of 400 nm to 700 nm, and wherein the conductive polymer is present in an amount of about 0.5 wt % to about 15 wt % in the transparent conductive film.

2. The transparent conductor as claimed in claim 1, wherein the transparent conductor has a haze value of about 1.0% to about 2.0% at wavelengths of 400 nm to 700 nm.

3. The transparent conductor as claimed in claim 1, wherein the transparent conductive film has a deviation of surface resistance from about 5% to about 15%.

4. The transparent conductor as claimed in claim 1, wherein the transparent conductive film is composed of a single layer.

5. The transparent conductor as claimed in claim 1, wherein the transparent conductive film has a thickness of about 10 nm to about 300 nm.

6. The transparent conductor as claimed in claim 1, wherein the metal nanowire is a silver nanowire, a copper nanowire, a gold nanowire, or a mixture thereof.

7. The transparent conductor as claimed in claim 1, wherein the metal nanowire is present in an amount of about 85 wt % to about 99 wt % in the transparent conductive film.

8. The transparent conductor as claimed in claim 1, wherein an aspect ratio (L/d) of a length (L) of the metal nanowire to a cross-sectional diameter (d) of the metal nanowire is about 10 to about 2,000.

9. The transparent conductor as claimed in claim 1, wherein the conductive polymer includes a water-based dopant.

10. The transparent conductor as claimed in claim 1, wherein the conductive polymer includes at least one of polystyrene sulfonate-doped polyethylene dioxythiophene or protein-doped polypyrrole.

11. The transparent conductor as claimed in claim 1, wherein the transparent conductive film is free from a compound including a urethane bond.

12. The transparent conductor as claimed in claim 1, further comprising a base layer on the transparent conductive film, the base layer including at least one film selected from a polycarbonate film, a polyester film, a polyolefin film, a cyclic olefin polymer film, a polysulfone film, a polyimide film, a silicone film, a polystyrene film, a polyacryl film, or a polyvinyl chloride film.

13. The transparent conductor as claimed in claim 1, wherein the transparent conductive film is formed of a composition including the metal nanowire, the conductive polymer, and a heat curing agent.

14. The transparent conductor as claimed in claim 13, wherein the composition further includes a UV curable unsaturated compound and a photopolymerization initiator.

15. An optical display apparatus comprising the transparent conductor as claimed in claim 1.

16. A composition for a transparent conductive film, the composition comprising:

a metal nanowire, a conductive polymer, and a heat curing agent, wherein the conductive polymer is present in an amount about 0.5 wt % to about 15 wt %, basd on a total weight of the metal nanowire and the conductive polymer.

17. The composition as claimed in claim 16, wherein the composition includes:

about 90 wt % to about 95 wt % of the metal nanowire, about 5 wt % to about 10 wt % of the conductive polymer, and about 0.01 parts by weight to about 1 part by weight of the heat curing agent, based on 100 total parts by weight of the metal nanowire and the conductive polymer.

18. The composition as claimed in claim 16, further comprising a UV curable unsaturated compound and a photopolymerization initiator.

19. The composition as claimed in claim 18, wherein the composition includes:

about 95 wt % to about 97 wt % of the metal nanowire, about 1 wt % to about 3 wt % of the conductive polymer, about 2 wt % to about 4 wt % of the UV curable unsaturated compound, and about 0.01 parts by weight to about 1 part by weight of the heat curing agent and about 0.01 parts by weight to about 1 part by weight of the photopolymerization initiator, based on 100 total parts by weight of the metal nanowire, the conductive polymer, and the UV curable unsaturated compound.

* * * * *